US009495912B2

(12) United States Patent
Kim

(10) Patent No.: US 9,495,912 B2
(45) Date of Patent: Nov. 15, 2016

(54) ORGANIC LIGHT EMITTING DISPLAY DEVICE

(71) Applicant: Samsung Display Co., Ltd., Yongin, Gyeonggi-do (KR)

(72) Inventor: Ki-Wook Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 17 days.

(21) Appl. No.: 14/547,015

(22) Filed: Nov. 18, 2014

(65) Prior Publication Data

US 2015/0145905 A1 May 28, 2015

(30) Foreign Application Priority Data

Nov. 22, 2013 (KR) ..... 10-2013-0142654

(51) Int. Cl.
*G09G 5/02* (2006.01)
*G09G 3/32* (2016.01)

(52) U.S. Cl.
CPC ..... *G09G 3/3275* (2013.01); *G09G 3/3208* (2013.01); *G09G 2300/0413* (2013.01); *G09G 2300/0452* (2013.01); *G09G 2330/08* (2013.01); *G09G 2330/10* (2013.01)

(58) Field of Classification Search
CPC ..... G09G 3/3275; G09G 3/3208; G09G 2300/0413; G09G 2300/0443; G09G 2300/0452; G09G 2320/0242; G09G 2320/043; G09G 2330/08; G09G 2330/10
See application file for complete search history.

(56) References Cited

U.S. PATENT DOCUMENTS

2004/0212633 A1* 10/2004 Natori ..... G09F 9/33 345/694
2006/0284683 A1* 12/2006 Ishii ..... G09G 3/3688 330/295
2007/0090410 A1* 4/2007 Chen ..... H01L 27/0251 257/223
2007/0109327 A1 5/2007 Cok et al.
2008/0252558 A1* 10/2008 Kim ..... G09G 3/2003 345/55
2011/0032249 A1* 2/2011 Moon ..... G09G 3/3607 345/214
2013/0147858 A1* 6/2013 Omoto ..... G09G 3/30 345/690

FOREIGN PATENT DOCUMENTS

KR 10-0611898 B1 8/2006
KR 10-2013-0008160 A 1/2013

* cited by examiner

*Primary Examiner* — Stephen Sherman
(74) *Attorney, Agent, or Firm* — Lewis Roca Rothgerber Christie LLP

(57) ABSTRACT

An organic light emitting display device includes a plurality of pixels and a data driver. The plurality of pixels are configured to form n pixel columns, the plurality of pixels each including at least three sub-pixels. The data driver is configured to supply a data signal to the sub-pixels through data lines. A defective pixel of the plurality of pixels includes a dark sub-pixel and three sub-pixels. Normal pixels of the plurality of pixels include sub-pixels positioned on a same sub-pixel column as the sub-pixels of the defective pixel. And the defective pixel and the normal pixels are positioned on an i-th pixel column of the n pixel columns.

18 Claims, 9 Drawing Sheets

C1
C2
C3
C4
C5
Pd1
Pd2
Po
Pn
Pe
db1
db2
db3
b1
b2
b3
bd
50
20
10
S1
S2
S3
S4
S5
S6
S7
S8
D1
D2
D3
D4
D5
D6
D7
D8
D9
D10
D11
D12
D13
D14
D15
D16
D17
D18
D19
D20
D21
SCAN DRIVER
DATA DRIVER

ORGANIC LIGHT EMITTING DISPLAY DEVICE

CROSS-REFERENCE TO RELATED APPLICATION

This application claims priority to and the benefit of Korean Patent Application No. 10-2013-0142654, filed on Nov. 22, 2013, in the Korean Intellectual Property Office, the entire content of which is incorporated herein by reference.

BACKGROUND

1. Field

Aspects of embodiments of the present invention relate to an organic light emitting display device.

2. Description of the Related Art

Recently, there have been developed various kinds of flat panel display devices with reduced weight and volume when compared to cathode ray tubes. Examples of the kinds of flat panel display devices include a liquid crystal display device, a field emission display device, a plasma display panel, an organic light emitting display device, and the like.

Among these flat panel display devices, the organic light emitting display device displays images using (e.g., utilizing) organic light emitting diodes that emit light through recombination of electrons and holes. The organic light emitting display has a fast response speed and is driven with low power consumption.

SUMMARY

According to an embodiment of the present invention, there is provided an organic light emitting display device, including: a plurality of pixels configured to form n pixel columns, the plurality of pixels each including at least three sub-pixels, and a data driver configured to supply a data signal to the sub-pixels through data lines, wherein a defective pixel of the plurality of pixels includes a dark sub-pixel and three sub-pixels, normal pixels of the plurality of pixels include sub-pixels positioned on a same sub-pixel column as the sub-pixels of the defective pixel, and the defective pixel and the normal pixels are positioned on an i-th pixel column of the n pixel columns.

Each of the normal pixels may further include two sub-pixels configured to emit a first color light, and two sub-pixels configured to respectively emit a second color light and a third color light.

The two sub-pixels configured to emit the second color light and the third color light may be positioned between the two sub-pixels configured to emit the first color light.

Any one of the two sub-pixels configured to emit the first color light may be positioned on the same sub-pixel column as the dark sub-pixel of the defective pixel.

Each of the pixels including three sub-pixels may be configured to emit different color light, and may be positioned on the pixel columns other than the i-th pixel column.

The defective pixel may include the dark sub-pixel, a sub-pixel configured to emit a first color light, a sub-pixel configured to emit a second color light, and a sub-pixel configured to emit a third color light.

The dark sub-pixel of the defective pixel may be positioned on the same sub-pixel column as any one of the two sub-pixels configured to emit the first color light of the normal pixels, the sub-pixel configured to emit the first color light of the defective pixel may be positioned on the same sub-pixel column as another one of the two sub-pixels configured to emit the first color light of the normal pixels, the sub-pixel configured to emit the second color light of the defective pixel may be positioned on the same sub-pixel column as the sub-pixel configured to emit the second color light of the normal pixels, and the sub-pixel configured to emit the third color light of the defective pixel may be positioned on the same sub-pixel column as the sub-pixel configured to emit the third color light of the normal pixels.

A data line coupled to the dark sub-pixel of the defective pixel and a data line coupled to the sub-pixel configured to emit the first color light of the defective pixel may be configured to receive a same data signal.

The data line coupled to the dark sub-pixel of the defective pixel may be coupled to sub-pixels of the normal pixels positioned on the same sub-pixel column as the dark sub-pixel, and the data line coupled to the sub-pixel configured to emit the first color light of the defective pixel may be coupled to sub-pixels of the normal pixels positioned on the same sub-pixel column as the sub-pixel configured to emit the first color light of the defective pixel.

The data driver may be configured to separately supply a same data signal to the data line coupled to the dark sub-pixel of the defective pixel and the data line coupled to the sub-pixel configured to emit the first color light of the defective pixel.

The organic light emitting display device may further include a shorting bar coupled (e.g., connected) between the data line coupled to the dark sub-pixel of the defective pixel and the data line coupled to the sub-pixel configured to emit the first color light of the defective pixel.

Any one of the data line coupled to the dark sub-pixel of the defective pixel and the data line coupled to the sub-pixel configured to emit the first color light of the defective pixel may be decoupled (e.g., disconnected) from the data driver and may be configured to receive a data signal supplied through the shorting bar.

The first, the second and the third color light may be different in color from one another.

The i-th may be an integer of 1 or more and less than or equal to a value of n.

A plurality of dummy sub-pixels configured to form at least one dummy sub-pixel column may be positioned at a left-side of a first pixel column of the n pixel columns.

A plurality of dummy sub-pixels configured to form another dummy sub-pixel column may be positioned at a right-side of an n-th pixel column of the n pixel columns.

BRIEF DESCRIPTION OF THE DRAWINGS

Example embodiments will now be described more fully hereinafter with reference to the accompanying drawings. However, embodiments of the present invention may be embodied in many different forms, and should not be construed as limited to the embodiments set forth herein. Rather, these embodiments are provided so that this disclosure will be thorough and complete, and will fully convey aspects of the example embodiments to those skilled in the art.

In the drawings, dimensions may be exaggerated for clarity of illustration. It will be understood by those skilled in the art that when an element is referred to as being "between" two elements, it can be the only element between the two elements, or one or more intervening elements may be present. Like reference numerals refer to like elements throughout.

DETAILED DESCRIPTION

Figure 1A:
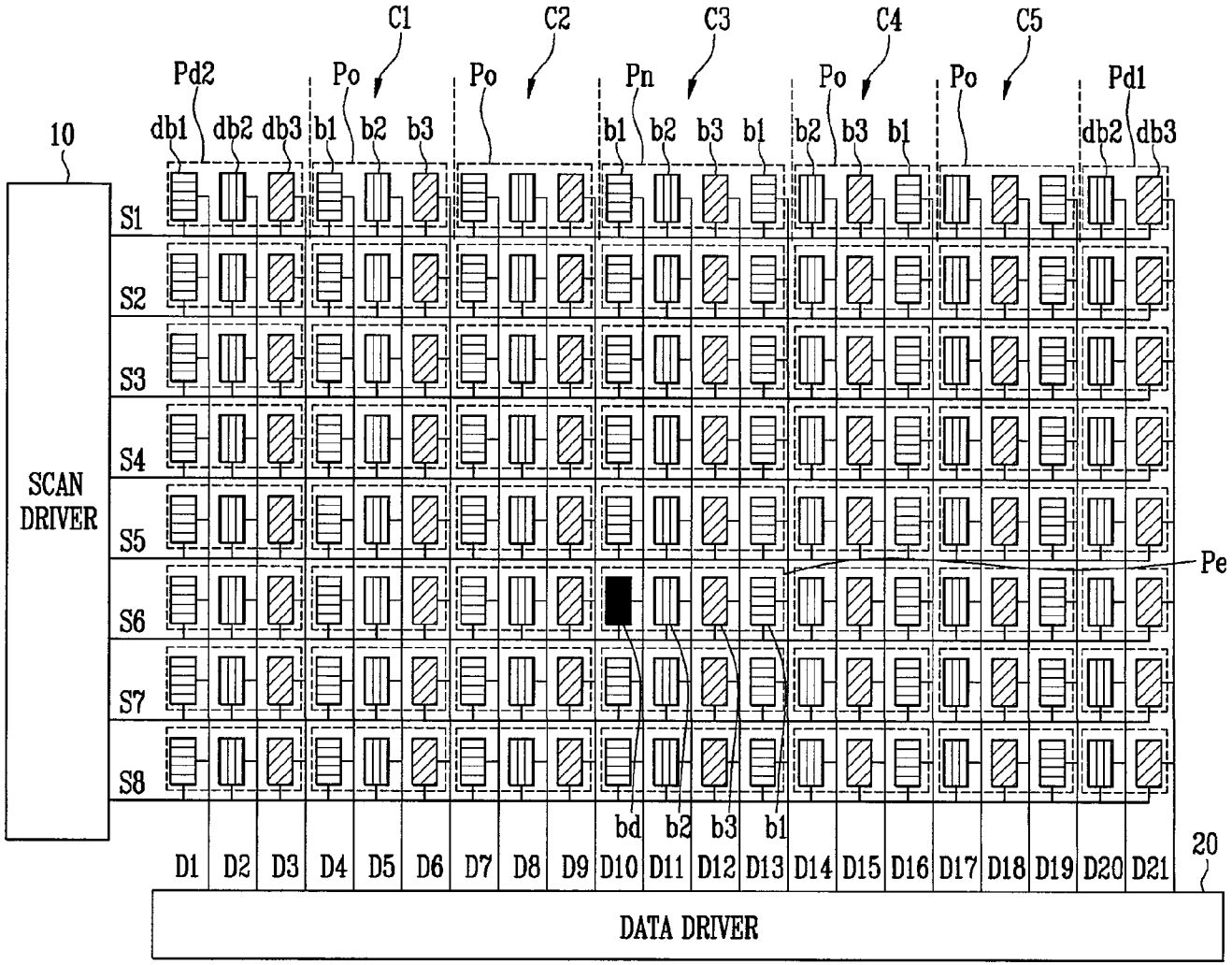
FIGS. 1A and 1B are diagrams of an organic light emitting display device according to embodiments of the present invention.

Hereinafter, example embodiments according to the present invention will be described with reference to the accompanying drawings. When a first element is described as being coupled to a second element, the first element may be directly coupled to the second element or may be indirectly coupled to the second element via one or more third elements. In addition, elements and operations that are not related to understanding the scope of the example embodiments of the present invention are omitted for clarity. Like reference numerals refer to like elements throughout the specification.

Figure 1B:
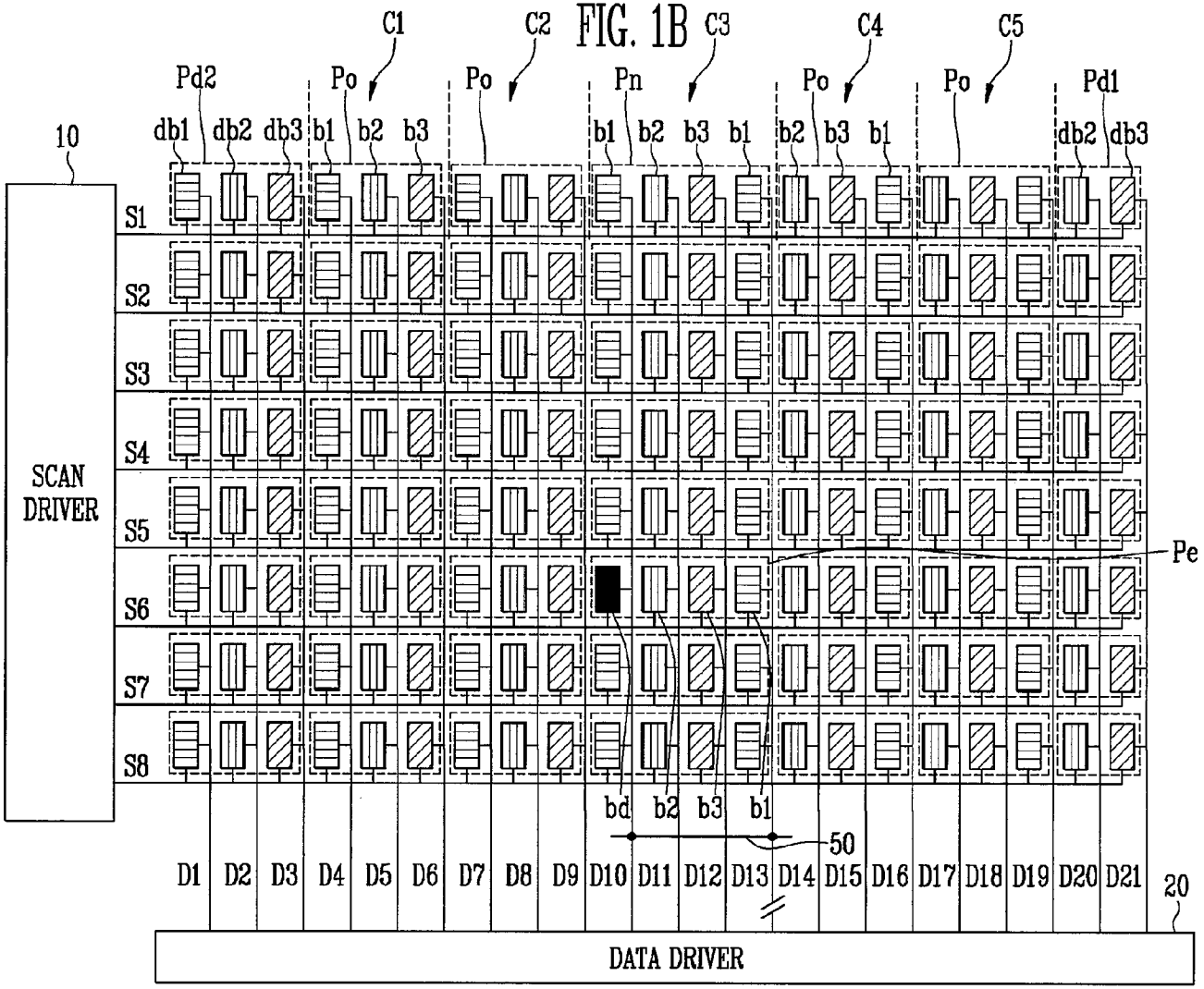
Figure 1C:
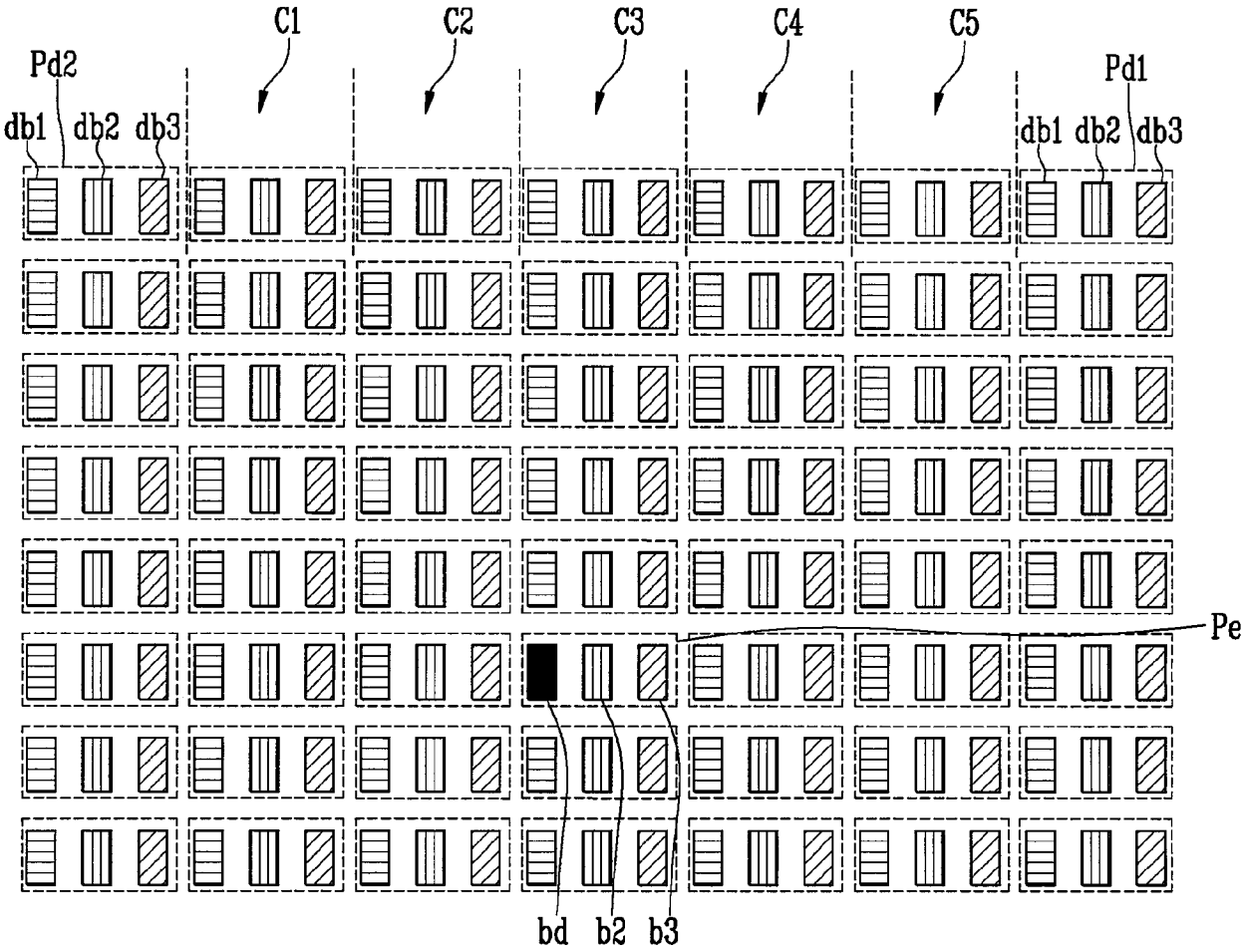
FIG. 1C is a diagram showing an example of a dark spot defect occurring in a first sub-pixel of a pixel according to the embodiments of FIGS. 1A and 1B.

FIGS. 1A and 1B are diagrams of an organic light emitting display device according to embodiments of the present invention. FIG. 1C is a diagram showing an example of a dark spot defect occurring in a first sub-pixel of a pixel according to the embodiments of FIGS. 1A and 1B.

Referring to FIG. 1A, an organic light emitting display device according to an embodiment of the present invention may include a plurality of pixels Po, Pn and Pe, a scan driver 10, and a data driver 20.

The plurality of pixels Po, Pn and Pe may form n pixel columns (e.g., where n is an integer of 2 or more), and each of the plurality of pixels Po, Pn and Pe may include at least three sub-pixels.

For example, in FIG. 1A the plurality of pixels Po, Pn and Pe form five pixel columns C1 to C5.

For convenience, in the embodiment of FIG. 1A, 40 pixels Po, Pn and Pe are shown, but the number of pixels Po, Pn and Pe are not limited thereto.

In the organic light emitting display device according to an embodiment of the present invention, when a dark spot defect occurs in any one pixel Pe positioned on an i-th pixel column (e.g., on a third pixel column C3) as shown in FIG. 1C, each pixel Pn or Pe positioned on the i-th pixel column includes four sub-pixels in order to reduce or minimize an image quality defect caused by a dark sub-pixel bd.

That is, compared to the organic light emitting display device shown in FIG. 1C, the pixels Pn and Pe included in the third pixel column C3 of the embodiment of FIG. 1A may have a range extended by one sub-pixel column in a right-side direction.

Accordingly, the defective pixel Pe may include a first sub-pixel b1, which can substitute for the dark sub-pixel bd.

Sequentially, pixels Po included in a fourth pixel column C4 and pixels Po included in a fifth pixel column C5 may also have a range extended by one sub-pixel column in the right-side direction, and have a range reduced by one sub-pixel column in a left-side direction.

The pixels Po of the fifth pixel column C5 may have ranges extended up to the first dummy sub-pixels db1 (see FIG. 1C) included in first dummy pixels Pd1 positioned at the right-side of the fifth pixel column C5.

The dummy sub-pixels do not perform a separate emission operation. However, the dummy sub-pixels (e.g., db1 of Pd1) that are included in the pixels Po positioned on a specific pixel column (e.g., the fifth pixel column C5) can perform a normal emission operation, like the other sub-pixels (e.g., b1, b2, and b3).

Thus, in the organic light emitting display device according to an embodiment of the present invention, a plurality of dummy sub-pixels db2 and db3, which form at least one dummy sub-pixel column, remain at the right-side of the last pixel column (e.g., the fifth pixel column C5) as shown, for example, in FIG. 1A.

In addition, a plurality of dummy sub-pixels db1, db2 and db3, which form another dummy sub-pixel column, may exist at the left-side of the first pixel column (e.g., a first pixel column C1).

The dummy sub-pixels (e.g., db1, db2 and db3) maintain a non-emission state.

The plurality of dummy sub-pixels db2 and db3 positioned at the right-side of the last pixel column (e.g., the last pixel column C5) may constitute a plurality of first dummy pixels Pd1, and the plurality of dummy sub-pixels db1, db2 and db3 positioned at the left-side of the first pixel column (e.g., the first pixel column C1) may constitute a plurality of second dummy sub-pixels Pd2.

Accordingly, in the organic light emitting display device according to the first embodiment of the present invention, a defective pixel Pe including a dark sub-pixel bd (e.g., the sub-pixel in which a dark spot defect occurs) and three sub-pixels b1, b2 and b3, and normal pixels Pn including sub-pixels b1, b2, b3 and b1 positioned on the same sub-pixel column as the sub-pixels bd, b1, b2 and b3 included in the defective pixel Pe, may be positioned on the i-th pixel column (e.g., the third pixel column C3 in FIG. 1A).

For example, in FIG. 1A, the pixels among the pixels positioned on the third column C3, other than the defective pixel Pe in which the dark spot defect occurs, may be defined as normal pixels Pn.

The normal pixels Pn may include two sub-pixels b1 configured to emit a first color light, and two sub-pixels b2 and b3 configured to respectively emit a second color light and a third color light.

The first, second and third color lights may be colors different from one another.

For example, the first, second and third color lights may be respectively set as red, green, and blue.

The normal pixels Pn positioned on the i-th pixel column (e.g., the third pixel column C3 in FIG. 1A) may include two first sub-pixels b1 configured to emit a first color light, one second sub-pixel b2 configured to emit a second color light, and one third sub-pixel b3 configured to emit a third color light.

The two sub-pixels b2 and b3 respectively emitting the second color light and the third color light may be positioned between the two sub-pixels b1, which are included in each normal pixel Pn and which emit the first color light.

For example, the second and third sub-pixels b2 and b3 may be positioned between the two first sub-pixels b1 included in each normal pixel Pn.

In addition, any one of the two sub-pixels b1, which are included in each normal pixel Pn and emit the first color light, may be positioned on the same sub-pixel column as the dark sub-pixel bd included in the defective pixel Pe.

For example, the first sub-pixel b1 positioned at the left-side of the two first sub-pixels b1 included in each normal pixel Pn may be positioned on the same sub-pixel column as the dark sub-pixel bd.

The pixels Po, each including three sub-pixels b1, b2 and b3 which emit lights of different colors, may be positioned on the other pixel columns of the n pixel columns except the i-th pixel column of the n pixel columns.

For example, in FIG. 1A, each of the first, second, fourth and fifth pixel columns C1, C2, C4 and C5 may include a first sub-pixel b1 configured to emit a first color light, a second sub-pixel b2 configured to emit a second color light, and a third sub-pixel b3 configured to emit a third color light.

The defective pixel Pe may include a dark sub-pixel bd that does not emit light normally due to the occurrence of a dark spot defect, a sub-pixel b1 configured to emit a first color light, a sub-pixel b2 configured to emit a second color light, and a sub-pixel b3 configured to emit a third color light.

The first, second and third color lights may be colors different from one another.

For example, the defective pixel Pe positioned on the i-th pixel column (the third pixel column C3 in FIG. 1A) may include a dark sub-pixel bd configured to display black by emitting no light, one first sub-pixel b1 configured to emit a first color light, one second sub-pixel b2 configured to emit a second color light, and one third sub-pixel b3 configured to emit a third color light.

In the embodiment shown in FIG. 1A, the two sub-pixels b2 and b3 respectively emitting the light of the second color and the third color may be positioned between the dark sub-pixel bd emitting no light and the first sub-pixel IA emitting the first color light.

The dark sub-pixel bd and the sub-pixels b1, b2 and b3, included in the defective pixel Pe, may be respectively positioned on the same sub-pixel columns as the sub-pixels b1, b2, b3 and b1 included in each normal pixel Pn.

For example, the dark sub-pixel bd of the defective pixel Pe may be positioned on the same sub-pixel column as any one of the two sub-pixels b1, which are included in each normal pixel Pn and emit the first color light. The first sub-pixel b1 of the defective pixel Pe, which emits the first color light, may be positioned on the same sub-pixel column as the other one of the two sub-pixels b1, which are included in each normal pixel Pn and emit the first color light.

The sub-pixel b2 of the defective pixel Pe, which emits the second color light, may be positioned on the same sub-pixel column as the sub-pixel b2, which is included in each normal pixel Pn and emits the second color light. The sub-pixel b3 of the defective pixel Pe, which emits the third color light, may be positioned on the same sub-pixel column as the sub-pixel b3 which is included in each normal pixel Pn and emits the third color light.

The sub-pixel b1, which is included in the defective pixel Pe and emits the first color light, performs a function of substituting for the dark sub-pixel bd. Therefore, the sub-pixel b1 included in the defective pixel Pe may be configured to receive the same data signal as the dark sub-pixel bd.

Thus, a data line D10 coupled to the dark sub-pixel bd of the defective pixel Pe, and a data line D13 coupled to the sub-pixel b1 of the defective pixel Pe may be configured to receive the same data signal.

For example, in an embodiment, the data driver 20, as shown in FIG. 1A, may separately supply the same data signal to the data line D10 coupled to the dark sub-pixel bd of the defective pixel Pe, and the data line D13 coupled to the sub pixel b1 of the defective pixel Pe, which emits the first color light.

In another embodiment, for example, the organic light emitting display device may further include a separate shorting bar 50 as shown in FIG. 1B.

That is, the shorting bar 50 may be coupled between the data line D10, which is coupled to the dark sub-pixel bd of the defective pixel Pe, and the data line D13, which is coupled to the sub-pixel b1 of the defective pixel Pe and emits the first color light. Thus, any one of the data lines D10 and D13 can receive a data signal supplied through the shorting bar 50, even when one of the data lines are not directly coupled (e.g., decoupled or disconnected) to the data driver 20.

For example, in FIG. 1B the sub-pixel b1 of the defective pixel Pe is decoupled from the data driver 20.

Alternatively, the data line D10 coupled to the dark sub-pixel bd of the defective pixel Pe may be decoupled from the data driver 20.

The data line D10 coupled to the dark sub-pixel bd of the defective pixel Pe may be coupled to the sub-pixel b1 of the normal pixels Pn positioned on the same sub-pixel column as the dark sub-pixel bd.

The data line D13 coupled to the sub-pixel b1 of the defective pixel Pe may be coupled to the sub-pixels b1 of the normal pixels Pn positioned on the same sub-pixel column as the sub-pixel b1 of the defective pixel Pe.

The scan driver 10 may supply a scan signal to scan lines S1 to Sn. Accordingly, the scan driver 10 may supply the scan signal to the sub-pixels included in the pixels Po, Pn and Pe, which form the n pixel columns (e.g., the first to fifth pixel columns C1 to C5 in FIG. 1A).

The data driver 20 may supply a data signal to data lines D1 to D21.

For example, the data driver 20 may supply a normal data signal corresponding to the emission luminance of each sub-pixel to the sub-pixels included in the pixels Po, Pn and Pe, which form the n pixel columns (the first to fifth pixel columns C1 to C5 in FIG. 1A), respectively through fourth to nineteenth data lines D4 to D19.

For example, when the scan driver 10 supplies a scan signal to a first scan line, the data driver 20 may respectively supply a corresponding data signal to the fourth to nineteenth data lines D4 to D19, in synchronization with the scan signal.

Accordingly, the corresponding data signal may be written in the sub-pixels positioned on the first to fifth pixel columns (e.g., the pixel columns C1 to C5), other than the dummy sub-pixels db1, db2 and db3 (e.g., positioned on the columns Pd2 and Pd1), and thus each sub-pixel positioned on the first to fifth columns can emit light with luminance corresponding to (e.g., according to) the data signal.

The dummy sub-pixels db1, db2 and db3 may maintain the non-emission state. Accordingly, the data driver 20 may supply a black data signal respectively to the first to third data lines D1 to D3 and the twentieth to twenty-first data lines D20 to D21.

Figure 2A:
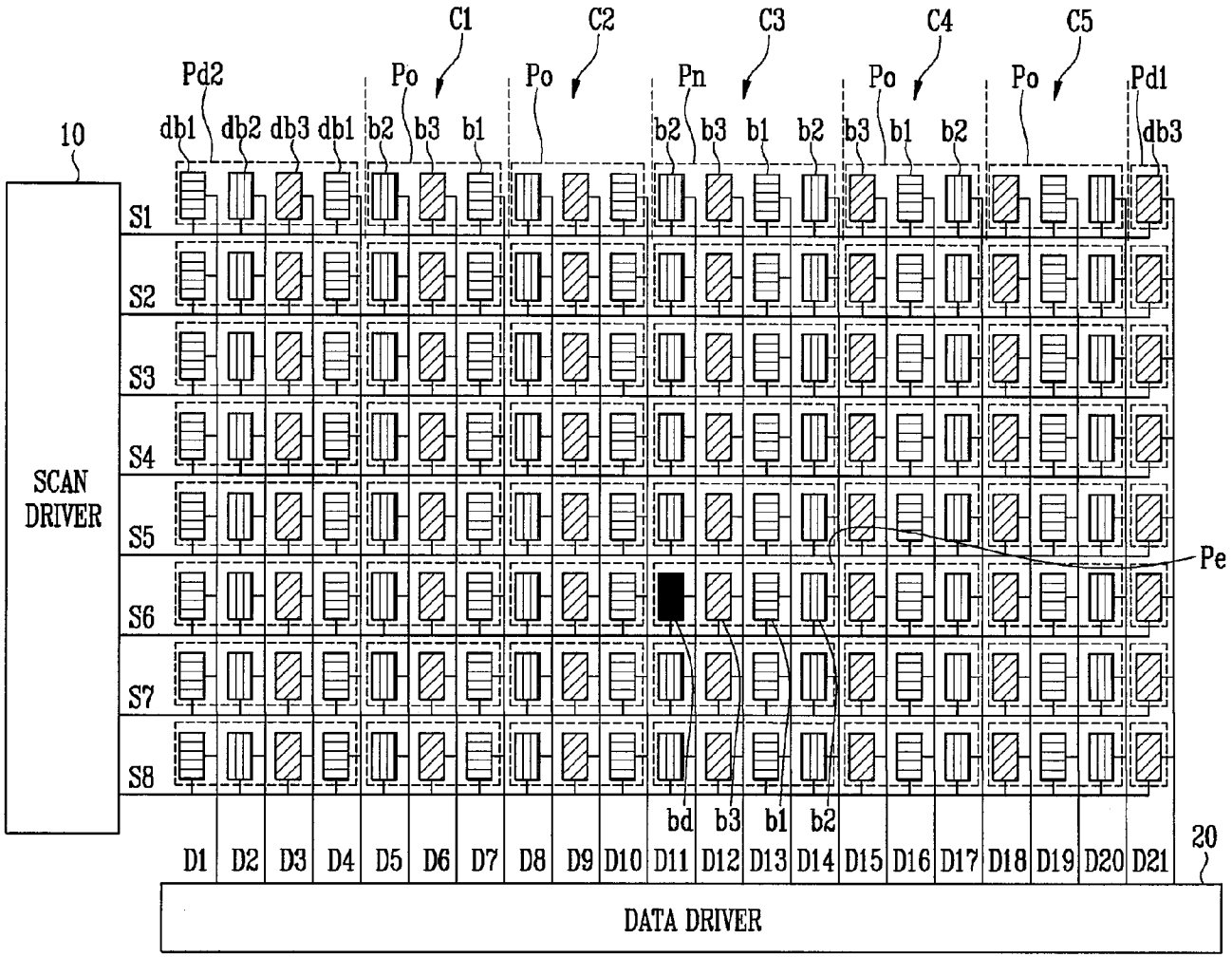
FIGS. 2A and 2B are diagrams of an organic light emitting display device according to embodiments of the present invention.
Figure 2B:
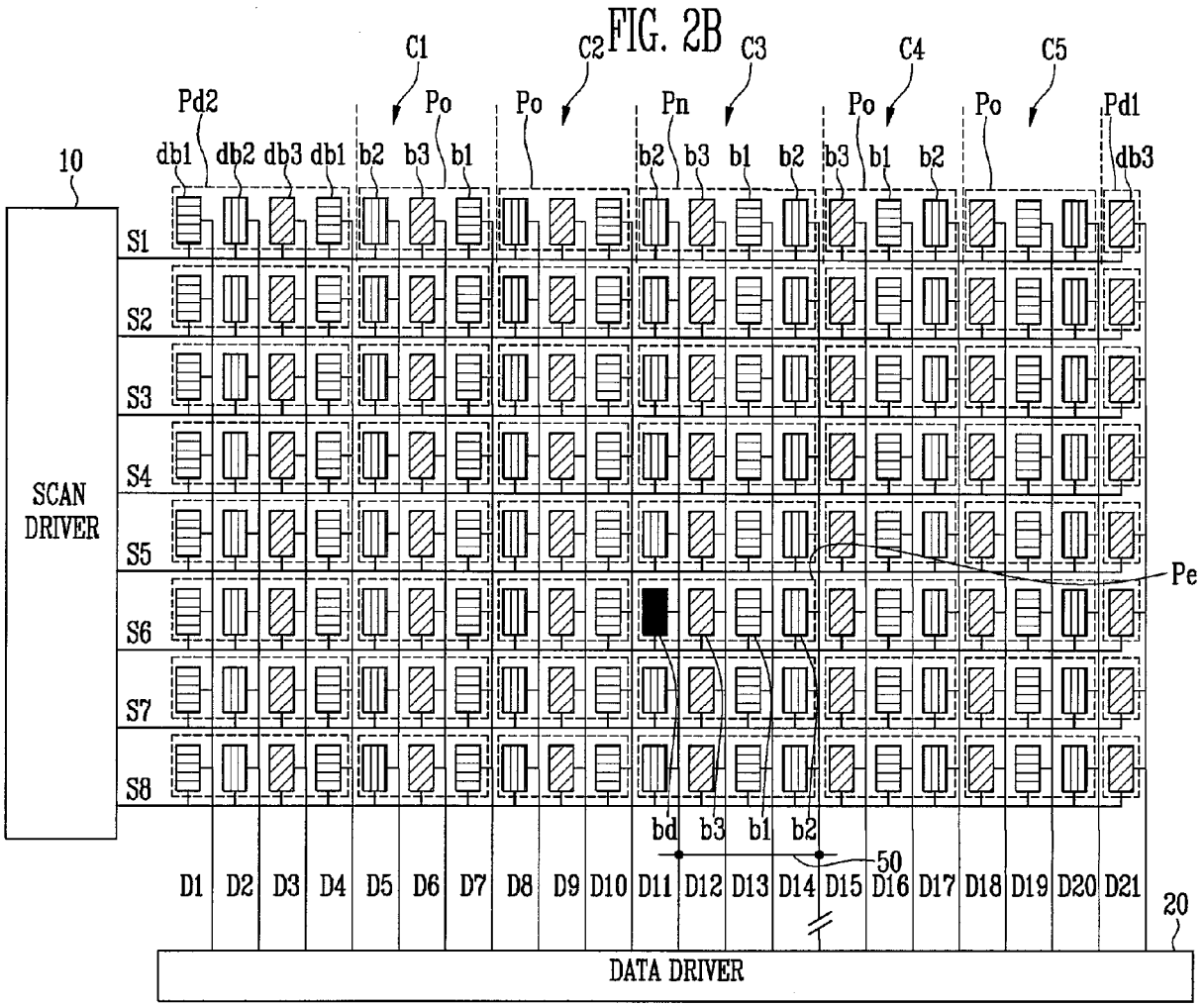
Figure 2C:
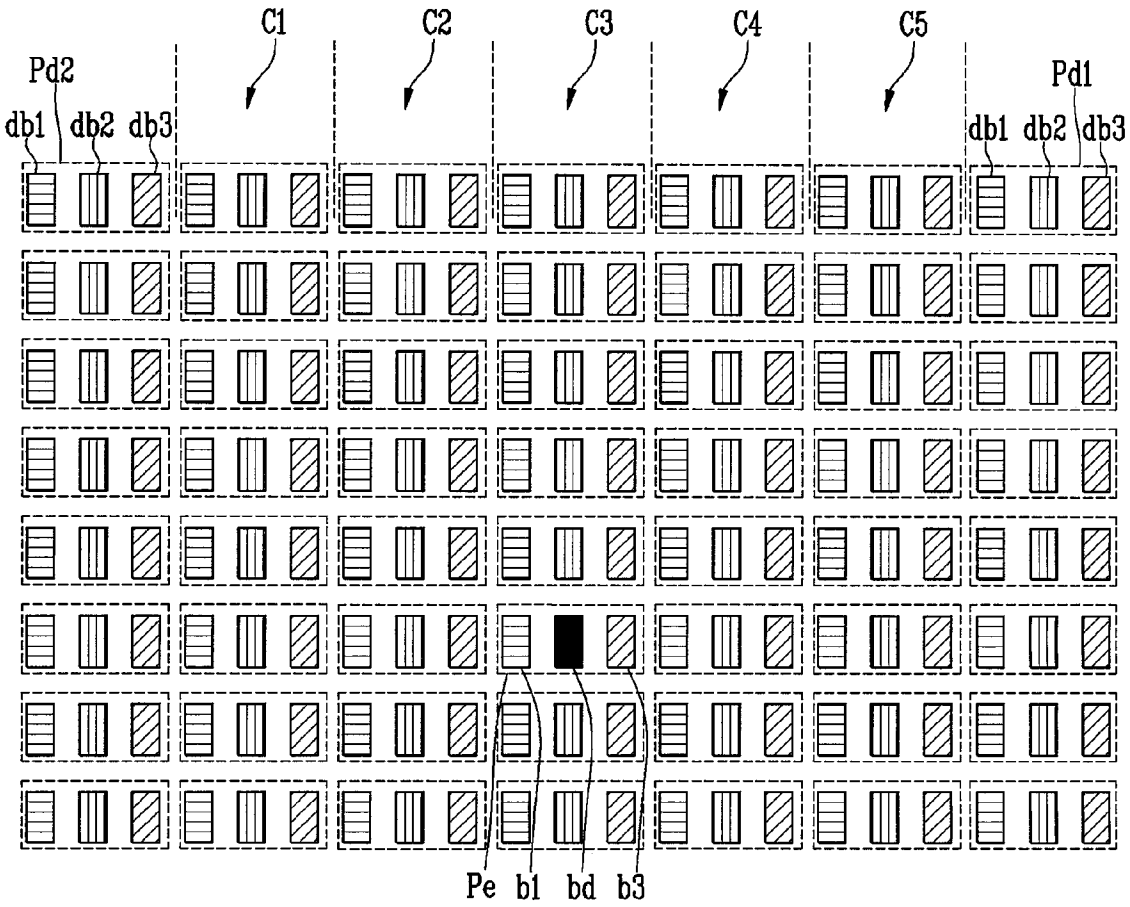
FIG. 2C is a diagram showing an example of a dark spot defect occurring in a second sub-pixel of a pixel according to the embodiments of FIGS. 2A and 2B.

FIGS. 2A and 2B are diagrams of an organic light emitting display device according to embodiments of the present invention. FIG. 2C is a diagram showing an example of a dark spot defect occurring in a second sub-pixel of a pixel according to the embodiments of FIGS. 2A and 2B.

Referring to FIG. 2A, an organic light emitting display device according to the second embodiment of the present invention may include a plurality of pixels Po, Pn and Pe, a scan driver 10, and a data driver 20.

The plurality of pixels Po, Pn and Pe may form n pixel columns (e.g., where n is an integer of 2 or more), and each of the plurality of pixels Po, Pn and Pe may include at least three sub-pixels.

For example, in FIG. 2A the plurality of pixels Po, Pn and Pe form five pixel columns C1 to C5.

For convenience, in the example embodiment of FIG. 2A, 40 pixels Po, Pn and Pe are shown, but the number of pixels Po, Pn and Pe are not limited thereto.

In the organic light emitting display device according to an embodiment of the present invention, when a dark spot defect occurs in any one pixel Pe positioned on an i-th pixel column (e.g., on a third pixel column C3) as shown in FIG. 2C, each pixel Pn or Pe positioned on the i-th pixel column includes four sub-pixels in order to reduce or minimize an image quality defect caused by a dark sub-pixel bd.

That is, compared the organic light emitting display device show in FIG. 2C, the pixels Pn and Pe included in the third pixel column C3 of the embodiment of FIG. 2A may have a range extended by two sub-pixel columns in the right-side direction, and have a range reduced by one sub-pixel column in the left-side direction.

Accordingly, the defective pixel Pe may include a second sub-pixel b2 which can substitute for the dark sub-pixel bd.

Sequentially, pixels Po included in a fourth pixel column C4 and pixels Po included in a fifth pixel column C5 may also have a range extended by two sub-pixel columns in the right-side direction, and have a range reduced by two sub-pixel columns in the left-side direction.

The pixels Po of the fifth pixel column C5 may have ranges extended up to the first and the second dummy sub-pixels db1 and db2 (see FIG. 2C) included in first dummy pixels Pd1 positioned at the right-side of the fifth pixel column C5.

The dummy sub-pixels do not perform a separate emission operation. However, the dummy sub-pixels that are included in the pixels Po positioned on a specific pixel column (e.g., the fifth pixel column C5) can perform a normal emission operation, like the other sub-pixels.

Thus, in the organic light emitting display device according to an embodiment of the present invention, a plurality of dummy sub-pixels db3, which form at least one dummy sub-pixel column, remain at the right-side of the last pixel column (e.g., the fifth pixel column C5) as shown, for example, in FIG. 2A.

In addition, a plurality of dummy sub-pixels db1, db2, db3, and db1 which form another dummy sub-pixel column, may exist at the left-side of the first pixel column (e.g., a first pixel column C1).

The dummy sub-pixels (e.g., db1, db2 and db3) maintain the non-emission state.

The plurality of dummy sub-pixels db3 positioned at the right-side of the last pixel column (e.g., the last pixel column C5) may constitute a plurality of first dummy pixels Pd1, and the plurality of dummy sub-pixels db1, db2, db3, and db1 positioned at the left-side of the first pixel column (e.g., the first pixel column C1) may constitute a plurality of second dummy sub-pixels Pd2.

Accordingly, in the organic light emitting display device according to an embodiment of the present invention, a defective pixel Pe including a dark sub-pixel bd (e.g., a sub-pixel in which a dark spot defect occurs) and three sub-pixels b1, b2 and b3, and normal pixels Pn including sub-pixels b1, b2, b2 and b3 positioned on the same sub-pixel column as the sub-pixels bd, b1, b2 and b3 included in the defective pixel Pe, may be positioned on the i-th pixel column (e.g., the third pixel column C3 in FIG. 2A).

For example, in FIG. 2A, the pixels among the pixels positioned on the third column C3, other than the defective pixel Pe in which the dark spot defect occurs, may be defined as normal pixels Pn.

The normal pixels Pn may include two sub-pixels b2 configured to emit a first color light, and two sub-pixels b3 and b1 configured to respectively emit a second color light and a third color light.

The first, second and third color lights may be colors different from one another.

For example, the first, second and third color lights may be respectively set as green, blue and red.

The normal pixels Pn positioned on the i-th pixel column (e.g., the third pixel column C3 in FIG. 2A) may include two second sub-pixels b2 configured to emit a first color light, one third sub-pixel b3 configured to emit a second color light, and one first sub-pixel b1 configured to emit a third color light.

The two sub-pixels b3 and b1 respectively emitting the second color light and the third color light may be positioned between the two sub-pixels b2, which are included in each normal pixel Pn and which emit the first color light.

For example, the third and first sub-pixels b3 and b1 may be positioned between the two second sub-pixels b2 included in each normal pixel Pn.

In addition, any one of the two sub-pixels b2, which are included in each normal pixel Pn and emit the first color light, may be positioned on the same sub-pixel column as the dark sub-pixel bd included in the defective pixel Pe.

For example, the second sub-pixel b2 positioned at the left-side of the two second sub-pixels b2 included in each normal pixel Pn may be positioned on the same sub-pixel column as the dark sub-pixel bd.

The pixels Po, each including three sub-pixels b1, b2 and b3 which emit lights of different colors, may be positioned on the other pixel columns of the n pixel columns except the i-th pixel column of the n pixel columns.

For example, in FIG. 2A, each of the first, second, fourth and fifth pixel columns C1, C2, C4 and C5 may include a second sub-pixel b2 configured to emit a first color light, a third sub-pixel b3 configured to emit a second color light, and a first sub-pixel b1 configured to emit a third color light.

The defective pixel Pe may include a dark sub-pixel bd that does not emit light normally due to the occurrence of a dark spot defect, a sub-pixel b2 configured to emit a first color light, a sub-pixel b3 configured to emit a second color light, and a sub-pixel b1 configured to emit a third color light.

The first, second and third color lights may be colors different from one another.

For example, the defective pixel Pe positioned on the i-th pixel column (e.g., the third pixel column C3 in FIG. 2A) may include a dark sub-pixel bd configured to display black by emitting no light, one second sub-pixel b2 configured to emit a first color light, one third sub-pixel b3 configured to emit a second color light, and one first sub-pixel b1 configured to emit a third color light.

In the embodiment shown in FIG. 2A, the two sub-pixels b3 and b1 respectively emitting the light of the second color and the third color may be positioned between the dark sub-pixel bd emitting no light and the second sub-pixel b2 emitting the first color light.

The dark sub-pixel bd and the sub-pixels b1, b2 and b3, included in the defective pixel Pe, may be respectively positioned on the same sub-pixel columns as the four sub-pixels b2, b3, b1 and b2 included in each normal pixel Pn.

For example, the dark sub-pixel bd of the defective pixel Pe may be positioned on the same sub-pixel column as any one of the two sub-pixels b2, which are included in each normal pixel Pn and emit the first color light. The second sub-pixel b2 of the defective pixel Pe, which emits the first color light, may be positioned on the same sub-pixel column as the other one of the two sub-pixels b2, which are included in each normal pixel Pn and emits the first color light.

The sub-pixel b3 of the defective pixel Pe, which emits the second color light, may be positioned on the same sub-pixel column as the sub-pixel b3, which is included in each normal pixel Pn and emits the second color light. The sub-pixel b1 of the defective pixel Pe, which emits the third color light, may be positioned on the same sub-pixel column as the sub-pixel b1, which is included in each normal pixel Pn and emits the third color light.

The sub-pixel b2, which is included in the defective pixel Pe and emits the first color light, performs a function of substituting for the dark sub-pixel bd. Therefore, the sub-pixel b2 of the defective pixel Pe may be configured to receive the same data signal as the dark sub-pixel bd.

Thus, a data line D11 coupled to the dark sub-pixel bd of the defective pixel Pe, and a data line D14 coupled to the sub-pixel b2 of the defective pixel Pe may be configured to receive the same data signal.

For example, in an embodiment, the data driver 20, as shown in FIG. 2A, may separately supply the same data signal to the data line D11 coupled to the dark sub-pixel bd of the defective pixel Pe, and the data line D14 coupled to the sub-pixel b2 of the defective pixel Pe and which emits the first color light.

In another embodiment, the organic light emitting display device may further include a separate shorting bar 50 as shown in FIG. 2B.

That is, the shorting bar 50 may be coupled between the data line D11, which is coupled to the dark sub-pixel bd of the defective pixel Pe, and the data line D14, which is coupled to the sub-pixel b2 of the defective pixel Pe and emits the first color light. Thus, any one of the data lines D11 and D14 can receive a data signal supplied through the shorting bar 50, even when one of the data lines are not directly coupled (e.g., decoupled or disconnected) to the data driver 20.

For example, in FIG. 2B the sub-pixel b2 of the defective pixel Pe is decoupled from the data driver 20.

Alternatively, the data line D11 coupled to the dark sub-pixel bd of the defective pixel Pe may be decoupled from the data driver 20.

The data line D11 coupled to the dark sub-pixel bd of the defective pixel Pe may be coupled to the sub-pixel b2 of the normal pixels Pn positioned on the same sub-pixel column as the dark sub-pixel bd.

The data line D14 coupled to the sub-pixel b2 of the defective pixel Pe may be coupled to the sub-pixels b2 of the normal pixels Pn positioned on the same sub-pixel column as the sub-pixel b2 of the defective pixel Pe.

The scan driver 10 may supply a scan signal to scan lines S1 to Sn. Accordingly, the scan driver 10 may supply the scan signal to the sub-pixels included in the pixels Po, Pn and Pe, which form n pixel columns (e.g., the first to fifth pixel columns C1 to C5 in FIG. 2A).

The data driver 20 may supply a data signal to data lines D1 to D21.

For example, the data driver 20 may supply a normal data signal corresponding to the emission luminance of each sub-pixel to the sub-pixels included in the pixels Po, Pn and Pe, which form the n pixel columns (the first to fifth pixel columns C1 to C5 in FIG. 2A), respectively through fifth to twentieth data lines D5 to D20.

For example, when the scan driver 10 supplies a scan signal to a first scan line, the data driver 20 may respectively supply a corresponding data signal to the fifth to twentieth data lines D5 to D20, in synchronization with the scan signal.

Accordingly, the corresponding data signal may be written in the sub-pixels positioned on the n pixel columns, other than the dummy sub-pixels db1, db2 and db3, and thus each sub-pixel receiving a data signal can emit light with luminance corresponding to the data signal.

The dummy sub-pixels (e.g., db1, db2 and db3) may maintain the non-emission state. Accordingly, the data driver 20 may supply a black data signal respectively to the first to fourth data lines D1 to D4 and to the twenty-first data line D21.

Figure 3A:
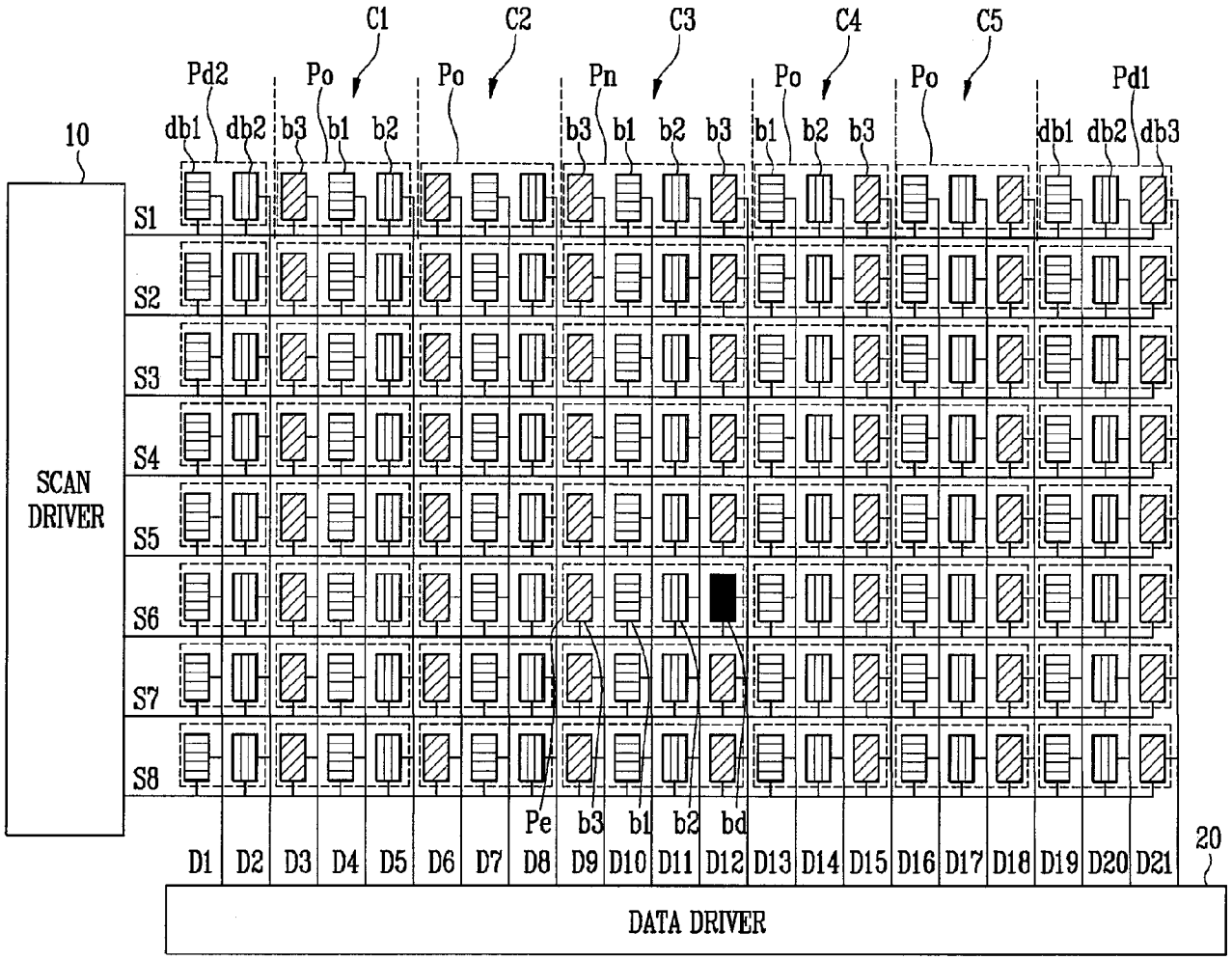
FIGS. 3A and 3B are diagrams of an organic light emitting display device according to embodiments of the present invention.
Figure 3B:
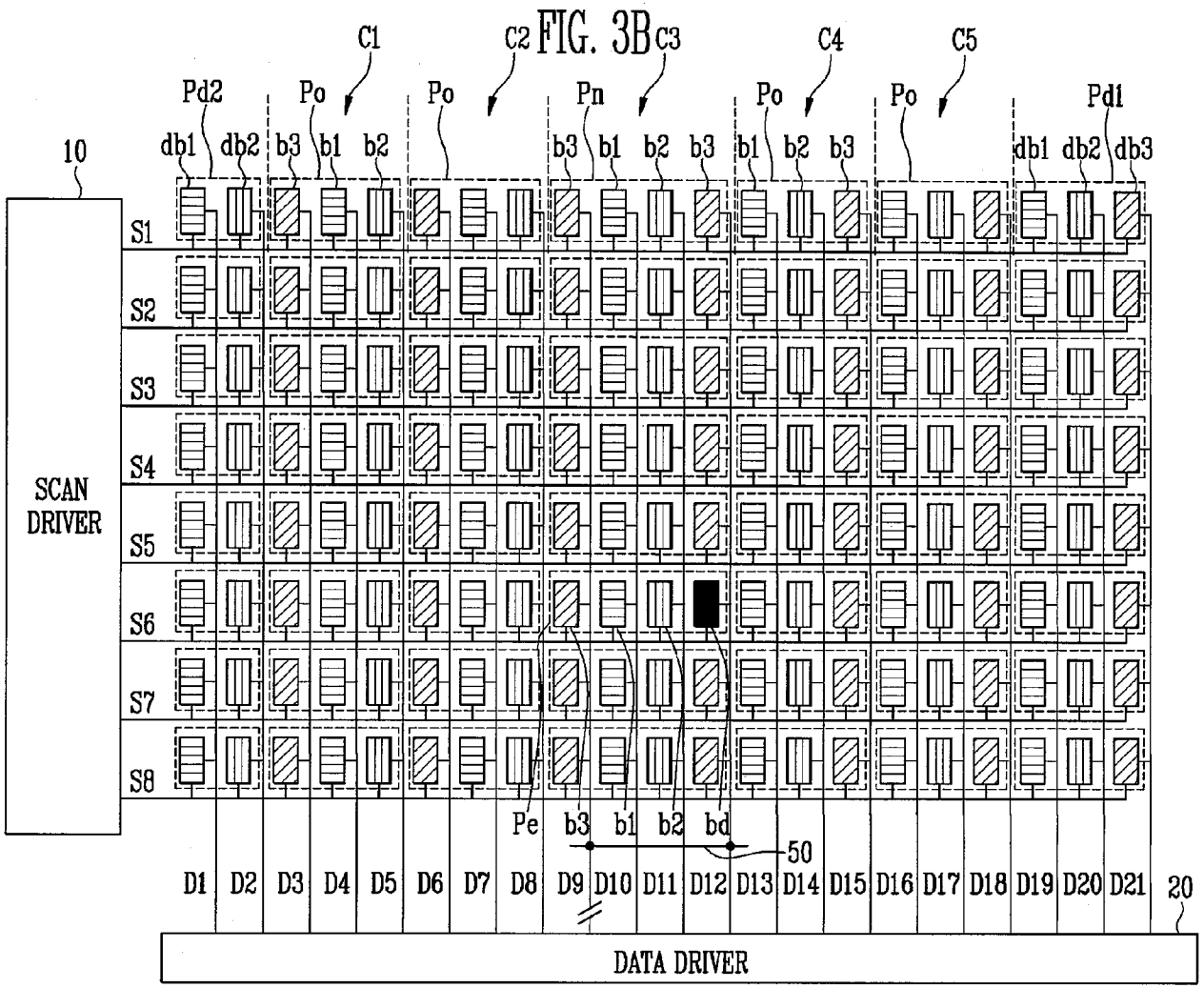
Figure 3C:
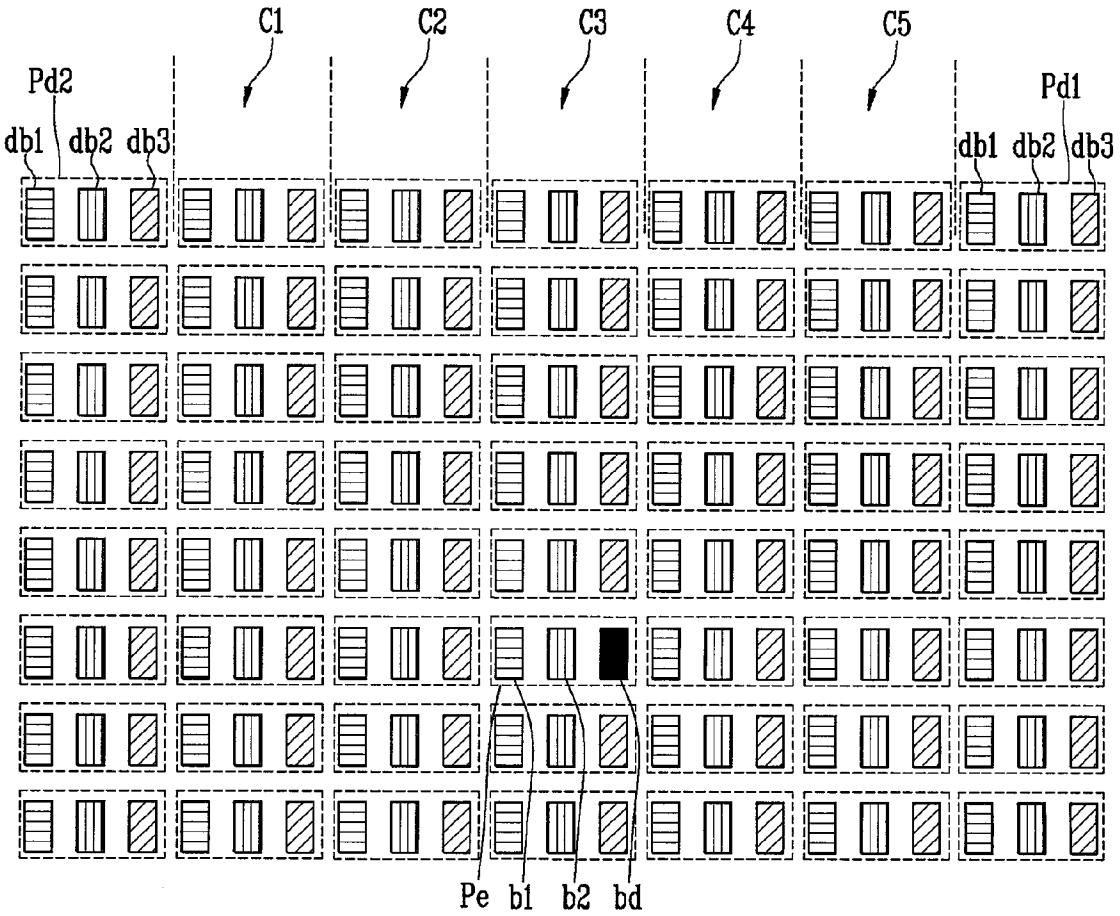
FIG. 3C is a diagram showing an example of a dark spot defect occurring in a third sub-pixel of a pixel according to the embodiments of FIGS. 3A and 3B.

FIGS. 3A and 3B are diagrams of an organic light emitting display device according embodiments of the present invention. FIG. 3C is a diagram showing an example of a dark spot defect occurring in a third sub-pixel of a pixel according to the embodiments of FIGS. 3A and 3B.

Referring to FIG. 3A, an organic light emitting display device according to an embodiment of the present invention may include a plurality of pixels Po, Pn and Pe, a scan driver 10, and a data driver 20.

The plurality of pixels Po, Pn and Pe may form n pixel columns (e.g., where n is an integer of 2 or more), and each of the plurality of pixels Po, Pn and Pe may include at least three sub-pixels.

For example, in FIG. 3A the plurality of pixels Po, Pn and Pe form five pixel columns C1 to C5.

For convenience, in the embodiment of FIG. 3A, 40 pixels Po, Pn and Pe are shown, but the number of pixels Po, Pn and Pe are not limited thereto.

In the organic light emitting display device according to an embodiment of the present invention, when a dark spot defect occurs in any one pixel Pe positioned on an i-th pixel column (e.g., on a third pixel column C3) as shown in FIG. 3C, each pixel Pn or Pe positioned on the i-th pixel column includes four sub-pixels in order to reduce or minimize an image quality defect caused by a dark sub-pixel bd.

That is, compared to the organic light emitting display device shown in FIG. 3C, the pixels Pn and Pe included in the third pixel column C3 of the embodiment of FIG. 3A may have a range extended by one sub-pixel column in a left-side direction.

Accordingly, the defective pixel Pe may include a third sub-pixel b3 which can substitute for the dark sub-pixel bd.

Sequentially, pixels Po included in a first pixel column C1 and pixels Po included in a second pixel column C2 may also have a range extended by one sub-pixel column in the left-side direction, and have a range reduced by one sub-pixel column in the right-side direction.

The pixels Po of the first pixel column C1 may have a range extended up to the third dummy sub-pixels db3 (see FIG. 3C) included in second dummy pixels Pd2 positioned at the left-side of the first pixel column C1.

The dummy sub-pixels do not perform a separate emission operation.

However, the dummy sub-pixels included in the pixels Po positioned on a specific pixel column (e.g., the first pixel column C1) can perform a normal emission operation, like the other sub-pixels (e.g., b1, b2, and b3).

Thus, in the organic light emitting display device according to an embodiment of the present invention, a plurality of dummy sub-pixels db1 and db2, which form at least one dummy sub-pixel column, remain at the left-side of the first pixel column (e.g., the first pixel column C1) as shown in FIG. 3A.

In addition, a plurality of dummy sub-pixels db1, db2 and db3, which may form another dummy sub-pixel column, may exist at the right-side of the last pixel column (e.g., a fifth pixel column C5).

The dummy sub-pixels (e.g., db1, db2 and db3) maintain the non-emission state.

The plurality of dummy sub-pixels db1, db2 and db3 positioned at the right-side of the last pixel column (e.g., the last pixel column C5) may constitute a plurality of first dummy pixels Pd1, and the plurality of dummy sub-pixels db1 and db2 positioned at the left-side of the first pixel column (e.g., the first pixel column C1) may constitute a plurality of second dummy sub-pixels Pd2.

Accordingly, in the organic light emitting display device according to an embodiment of the present invention, a defective pixel Pe including a dark sub-pixel bd (e.g., the sub-pixel in which a dark spot defect occurs) and three sub-pixels b1, b2 and b3, and normal pixels Pn including sub-pixels b1, b2 and b3 positioned on the same sub-pixel column as the sub-pixels bd, b1, b2 and b3 included in the defective pixel Pe, may be positioned on the i-th pixel column (e.g., the third pixel column C3 in FIG. 3A).

For example, in FIG. 3A, the pixels among the pixels positioned on the third column C3, other than the defective pixel Pe in which the dark spot defect occurs, may be defined as normal pixels Pn.

The normal pixels Pn may include two sub-pixels b3 configured to emit a first color light, and two sub-pixels b1 and b2 configured to respectively emit a second color light and a third color light.

The first, second and third color lights may be colors different from one another.

For example, the first, second and third color lights may be respectively set as blue, red and green.

The normal pixels Pn positioned on the i-th pixel column (e.g., the third pixel column C3 in FIG. 3A) may include two third sub-pixels b3 configured to emit a first color light, one first sub-pixel b1 configured to emit a second color light, and one second sub-pixel b2 configured to emit a third color light.

The two sub-pixels b1 and b2 respectively emitting the second color light and the third color light may be positioned between the two sub-pixels b3, which are included in each normal pixel Pn and which emit the first color light.

For example, the first and second sub-pixels b1 and b2 may be positioned between the two third sub-pixels b3 included in each normal pixel Pn.

In addition, any one of the two sub-pixels b3, which are included in each normal pixel Pn and emit the first color light, may be positioned on the same sub-pixel column as the dark sub-pixel bd included in the defective pixel Pe.

For example, the third sub-pixel b3 positioned at the right-side of the two third sub-pixels b3 included in each normal pixel Pn may be positioned on the same sub-pixel column as the dark sub-pixel bd.

The pixels Po, each including three sub-pixels b1, b2 and b3 which emit lights of different colors, may be positioned on the other pixel columns of the n pixel columns except the i-th pixel column of the n pixel columns.

For example, in FIG. 3A, each of the first, second, fourth and fifth pixel columns C1, C2, C4 and C5 may include a third sub-pixel b3 configured to emit a first color light, a first sub-pixel b1 configured to emit a second color light, and a second sub-pixel b2 configured to emit a third color light.

The defective pixel Pe may include a dark sub-pixel bd, that does not emit light normally due to the occurrence of a dark spot defect, a sub-pixel b3 configured to emit a first color light, a sub-pixel b1 configured to emit a second color light, and a sub-pixel b2 configured to emit a third color light.

The first, second and third color lights may be colors different from one another.

For example, the defective pixel Pe positioned on the i-th pixel column (e.g., the third pixel column C3 in FIG. 3A) may include a dark sub-pixel bd configured to display black by emitting no light, one third sub-pixel b3 configured to emit a first color light, one first sub-pixel b1 configured to emit a second color light, and one second sub-pixel b2 configured to emit a third color light.

In the embodiment shown in FIG. 3A, the two sub-pixels b1 and b2 respectively emitting the light of the second color and third color may be positioned between the dark sub-pixel bd emitting no light and the third sub-pixel b3 emitting the first color light.

The dark sub-pixel bd and the sub-pixels b1, b2 and b3, included in the defective pixel Pe, may be respectively positioned on the same sub-pixel columns as the four sub-pixels b3, b1, b2 and b3 included in each normal pixel Pn.

For example, the dark sub-pixel bd of the defective pixel Pe may be positioned on the same sub-pixel column as any one of the two sub-pixels b3, which are included in each normal pixel Pn and emit the first color light. The third sub-pixel b3 of the defective pixel Pe, which emits the first color light, may be positioned on the same sub-pixel column as the other one of the two sub-pixels b3, which are included in each normal pixel Pn and emit the first color light.

The sub-pixel b1 of the defective pixel Pe, which emits the second color light, may be positioned on the same sub-pixel column as the sub-pixel b1, which is included in each normal pixel Pn and emits the second color light. The sub-pixel b2 of the defective pixel Pe, which emits the third color light, may be positioned on the same sub-pixel column as the sub-pixel b2, which is included in each normal pixel Pn and emits the third color light.

The sub-pixel b3, which is included in the defective pixel Pe and emits the first color light, performs a function of substituting for the dark sub-pixel bd. Therefore, the sub-pixel b3 included in the defective pixel Pe may be configured to receive the same data signal as the dark sub-pixel bd.

Thus, a data line D12 coupled to the dark sub-pixel bd of the defective pixel Pe, and a data line D9 coupled to the sub-pixel b3 of the defective pixel Pe may be configured to receive the same data signal.

For example, in one embodiment, the data driver 20, as shown in FIG. 3A, may separately supply the same data signal to the data line D12 coupled to the dark sub-pixel bd of the defective pixel Pe, and the data line D9 coupled to the sub-pixel b3 of the defective pixel Pe, which emits the first color light.

In another embodiment, for example, the organic light emitting display device may further include a separate shorting bar 50 as shown in FIG. 3B.

That is, the shorting bar 50 may be coupled between the data line D12, which is coupled to the dark sub-pixel bd of the defective pixel Pe, and the data line D9, which is coupled to the sub-pixel b3 of the defective pixel Pe and emits the first color light. Thus, any one of the data lines D9 and D12 can receive a data signal supplied through the shorting bar 50, even when one of the data lines are not directly coupled (e.g., decoupled or disconnected) to the data driver 20.

For example, in FIG. 3B the sub-pixel b3 of the defective pixel Pe is decoupled from the data driver 20.

In another embodiment, the data line D12 coupled to the dark sub-pixel bd of the defective pixel Pe may be decoupled from the data driver 20.

The data line D12 coupled to the dark sub-pixel bd of the defective pixel Pe may be coupled to the sub-pixel b3 of the normal pixels Pn positioned on the same sub-pixel column as the dark sub-pixel bd.

The data line D9 coupled to the sub-pixel b3 of the defective pixel Pe may be coupled to the sub-pixels b3 of the normal pixels Pn positioned on the same sub-pixel column as the sub-pixel b3 of the defective pixel Pe.

The scan driver 10 may supply a scan signal to scan lines S1 to Sn. Accordingly, the scan driver 10 may supply the scan signal to the sub-pixels included in the pixels Po, Pn and Pe, which form n pixel columns (e.g., the first to fifth pixel columns C1 to C5 in FIG. 3A).

The data driver 20 may supply a data signal to data lines D1 to D21.

For example, the data driver 20 may supply a normal data signal corresponding to the emission luminance of each sub-pixel to the sub-pixels included in the pixels Po, Pn and Pe, which form the n pixel columns (e.g., the first to fifth pixel columns C1 to C5 in FIG. 3A), respectively through third to eighteenth data lines D3 to D18.

For example, when the scan driver 10 supplies a scan signal to a first scan line, the data driver 20 may respectively supply a corresponding data signal to the third to eighteenth data lines D3 to D18, in synchronization with the scan signal.

Accordingly, the corresponding data signal may be written in the sub-pixels positioned on the pixel columns, other than the dummy sub-pixels db1, db2 and db3, and thus each sub-pixel receiving a data signal can emit light with luminance corresponding to the data signal.

The dummy sub-pixels (e.g., db1, db2 and db3) may maintain the non-emission state. Accordingly, the data driver 20 may supply a black data signal to the first to second data lines D1 to D2 and the nineteenth to twenty-first data lines D19 to D21.

In view of the foregoing, a foreign material may be penetrated in a process of laminating an anode electrode, an emission layer, and a cathode electrode, which constitute an organic light emitting diode. The penetrated foreign material may cause a short circuit between the anode and cathode electrodes, and therefore, a dark spot defect where a sub-pixel does not emit light may occur.

In addition, a dark spot defect of a specific sub-pixel may occur due to a defect of a thin film transistor or the like, which constitute, together with the organic light emitting diode, a pixel.

The sub-pixel in which the dark spot defect occurs cannot perform an emission operation normally. Therefore, the sub-pixel may become a permanent dark pixel.

For example, when a dark spot defect occurs in any one of red, green and blue sub-pixels included in a pixel, the pixel may be entirely recognized as a defective pixel even though the other sub-pixels are operating normally.

According to embodiments of the present invention, it may be possible to provide an organic light emitting display device in which a user may not be able to recognize a pixel in which an actual dark spot defect occurs even though the dark spot defect occurred.

The embodiments described herein have been provided as examples only and should not be construed as limiting the embodiments of the present invention in any way. Accordingly, it will be understood by those skilled in the art that various modifications in form and detail may be made without departing from the spirit and scope of the present invention as defined in the appended claims, and equivalents thereof.

What is claimed is:

1. An organic light emitting display device, comprising:

a plurality of light-emitting pixels configured to form n pixel columns, where n is an integer greater than or equal to 2, the plurality of pixels each comprising at least three sub-pixels; and a data driver configured to supply a data signal to the sub-pixels through data lines, wherein a defective pixel of the plurality of pixels comprises a dark sub-pixel and three sub-pixels, normal pixels of the plurality of pixels comprise sub-pixels positioned on a same sub-pixel column as the sub-pixels of the defective pixel, and the defective pixel and the normal pixels are positioned on an i-th pixel column, where i is an integer less than or equal to n, of the n pixel columns, and wherein the normal pixels and the defective pixel have a different number of sub-pixels than those of other ones of the plurality of pixels.

2. The organic light emitting display device of claim 1, wherein each of the normal pixels further comprises two sub-pixels configured to emit a first color light, and two sub-pixels configured to respectively emit a second color light and a third color light.

3. The organic light emitting display device of claim 2, wherein the two sub-pixels configured to respectively emit the second color light and the third color light are positioned between the two sub-pixels configured to emit the first color light.

4. The organic light emitting display device of claim 3, wherein the defective pixel comprises the dark sub-pixel, a sub-pixel configured to emit a first color light, a sub-pixel configured to emit a second color light, and a sub-pixel configured to emit a third color light.

5. The organic light emitting display device of claim 4, wherein the dark sub-pixel of the defective pixel is positioned on the same sub-pixel column as any one of the two sub-pixels configured to emit the first color light of the normal pixels, the sub-pixel configured to emit the first color light of the defective pixel is positioned on the same sub-pixel column as another one of the two sub-pixels configured to emit the first color light of the normal pixels, the sub-pixel configured to emit the second color light of the defective pixel is positioned on the same sub-pixel column as the sub-pixel configured to emit the second color light of the normal pixels, and the sub-pixel configured to emit the third color light of the defective pixel is positioned on the same sub-pixel column as the sub-pixel configured to emit the third color light of the normal pixels.

6. The organic light emitting display device of claim 4, wherein a data line coupled to the dark sub-pixel of the defective pixel and a data line coupled to the sub-pixel configured to emit the first color light of the defective pixel are configured to receive a same data signal.

7. The organic light emitting display device of claim 6, wherein the data line coupled to the dark sub-pixel of the defective pixel is coupled to sub-pixels of the normal pixels positioned on the same sub-pixel column as the dark sub-pixel, and the data line coupled to the sub-pixel configured to emit the first color light of the defective pixel is coupled to sub-pixels of the normal pixels positioned on the same sub-pixel column as the sub-pixel configured to emit the first color light of the defective pixel.

8. The organic light emitting display device of claim 6, wherein the data driver is configured to separately supply a same data signal to the data line coupled to the dark sub-pixel of the defective pixel and the data line coupled to the sub-pixel configured to emit the first color light of the defective pixel.

9. The organic light emitting display device of claim 6, further comprising a shorting bar coupled between the data line coupled to the dark sub-pixel of the defective pixel and the data line coupled to the sub-pixel configured to emit the first color light of the defective pixel.

10. The organic light emitting display device of claim 9, wherein any one of the data line coupled to the dark sub-pixel of the defective pixel and the data line coupled to the sub-pixel configured to emit the first color light of the defective pixel is decoupled from the data driver, and configured to receive a data signal supplied through the shorting bar.

11. The organic light emitting display device of claim 4, wherein the first, the second, and the third color light are different in color from one another.

12. The organic light emitting display device of claim 2, wherein any one of the two sub-pixels configured to emit the first color light is positioned on the same sub-pixel column as the dark sub-pixel of the defective pixel.

13. The organic light emitting display device of claim 2, wherein the first, the second and the third color light are different in color from one another.

14. The organic light emitting display device of claim 1, wherein the other ones of the plurality of pixels comprise three sub-pixels, and the three sub-pixels are configured to emit different color light, and are positioned on the pixel columns other than the i-th pixel column.

15. The organic light emitting display device of claim 1, wherein the i-th is an integer of 1 or more and less than or equal to a value of n.

16. The organic light emitting display device of claim 1, wherein a plurality of dummy sub-pixels configured to form at least one dummy sub-pixel column are positioned at a left-side of a first pixel column of the n pixel columns.

17. The organic light emitting display device of claim 16, wherein a plurality of dummy sub-pixels configured to form another dummy sub-pixel column are positioned at a right-side of an n-th pixel column of the n pixel columns.

18. The organic light emitting display device of claim 1, wherein the normal pixels have a greater number of sub-pixels than those of the other ones of the plurality of pixels.

* * * * *